US005267933A

United States Patent [19]

Precoma

[11] Patent Number: 5,267,933

[45] Date of Patent: Dec. 7, 1993

[54] FOLDING MACHINE, PARTICULARLY FOR SIGNATURES

[75] Inventor: Giuseppe Precoma, Turin, Italy

[73] Assignee: Bonelli Industrie S.r.l., Turin, Italy

[21] Appl. No.: 909,700

[22] Filed: Jul. 7, 1992

[30] Foreign Application Priority Data

Jul. 8, 1991 [IT] Italy ..... T091 A 000529

[51] Int. Cl.[5] ..... B65H 45/18

[52] U.S. Cl. ..... 493/23; 493/444; 493/458

[58] Field of Search ..... 493/1, 2, 23, 415, 419, 493/420, 421, 443, 444, 445, 458

[56] References Cited

U.S. PATENT DOCUMENTS

| | | | |
|---|---|---|---|
| 2,834,595 | 5/1958 | Gilchrist | 493/23 |
| 3,260,518 | 7/1966 | Kamberg et al. | 493/23 |
| 3,363,897 | 1/1968 | Northern et al. | 493/23 |
| 4,234,179 | 11/1980 | Weir | 493/14 |
| 4,518,381 | 5/1985 | Wakatsuki | 493/444 |
| 4,601,695 | 7/1986 | Pazzi | 493/418 |
| 5,045,039 | 9/1991 | Bay | 493/1 |
| 5,092,832 | 3/1992 | Crowley | 493/421 |
| 5,120,291 | 6/1992 | Wada et al. | 493/23 |

FOREIGN PATENT DOCUMENTS

| | | |
|---|---|---|
| 0131310A1 | 1/1985 | European Pat. Off. . |
| 3830656C1 | 11/1989 | Fed. Rep. of Germany . |

*Primary Examiner*—William E. Terrell

*Attorney, Agent, or Firm*—Kane, Dalsimer, Sullivan, Kurucz, Levy, Eisele & Richard

[57] ABSTRACT

A folding machine including a feeding unit which successively feeds sheets form a stack to a folding station. At the folding station an intermediate portion of each sheet is pushed by a pushing unit between two counter-rotating rollers to be folded in half. Advantageously, the feeding unit, the pushing unit and the rollers are driven by independent motors and controlled by a programmed control unit.

7 Claims, 3 Drawing Sheets

FOLDING MACHINE, PARTICULARLY FOR SIGNATURES

BACKGROUND OF THE INVENTION

The present invention relates to a folding machine, particularly for folding signatures of a printed sheet.

Here and hereinafter, the term "sheet material" is intended to mean either a single sheet or a signature produced by folding the same.

A standard practice in the printing industry is to print a number of pages of a given text on one sheet, which is then fed on to a folding machine in which the sheet is fed through one or more folding stations to form a respective signature.

At each folding station, the sheet is folded in half as often as required for forming the signature, each page of which normally corresponds with a page of the printed text.

On commonly used folding machines, for folding the sheet as described above, each folding station features at least one folding unit defined by two counter-rotating rollers between which an intermediate portion of the sheet is fed by means of units usually comprising a conveyor for feeding the sheet transversely in relation to the rollers of the respective folding unit, and a knife device facing, parallel to, and moving back and forth in relation to the folding rollers.

The knife device provides for engaging the intermediate portion of the sheet transversely in relation to the traveling direction, and for feeding it between the two counter-rotating rollers by which the sheet is folded in half and either fed to the output or to a further folding station.

On known folding machines of the aforementioned type, the folding and feed units of all the folding stations are generally powered, in time with one another, by a single motor, which, while on the one hand providing for substantial saving in terms of machinery cost, and for simplifying timing of the various folding stations, on the other, practically eliminates any and all flexibility of the machinery in terms of output rate. This, in fact, is limited to the maximum rate compatible with the mechanical resistance of the most highly stressed components on the machine, and allows of substantially no variation for different sheet formats, i.e. for increasing the output rate in inverse proportion to the sheet format for a given stress on the machine components.

SUMMARY OF THE INVENTION

It is an object of the present invention to provide a folding machine of the aforementioned type designed to overcome the aforementioned drawback.

In particular, it is an object of the present invention to provide a folding machine of the aforementioned type, the output rate of which may be varied, for a given stress on the machine components, alongside a variation in the sheet format.

According to the present invention, there is provided a folding machine, particularly for signatures, for successively feeding a sheet along a given folding path; said folding machine comprising at least one folding station located along said path and comprising at least one folding unit defined by two counter-rotating rollers; at least one feed unit for supplying said folding unit with an intermediate portion of each said sheet material; and means for driving said feed and folding units; characterized by the fact that said drive means comprise a drive device for each said unit; and a programmed control unit for coordinating said drive devices.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
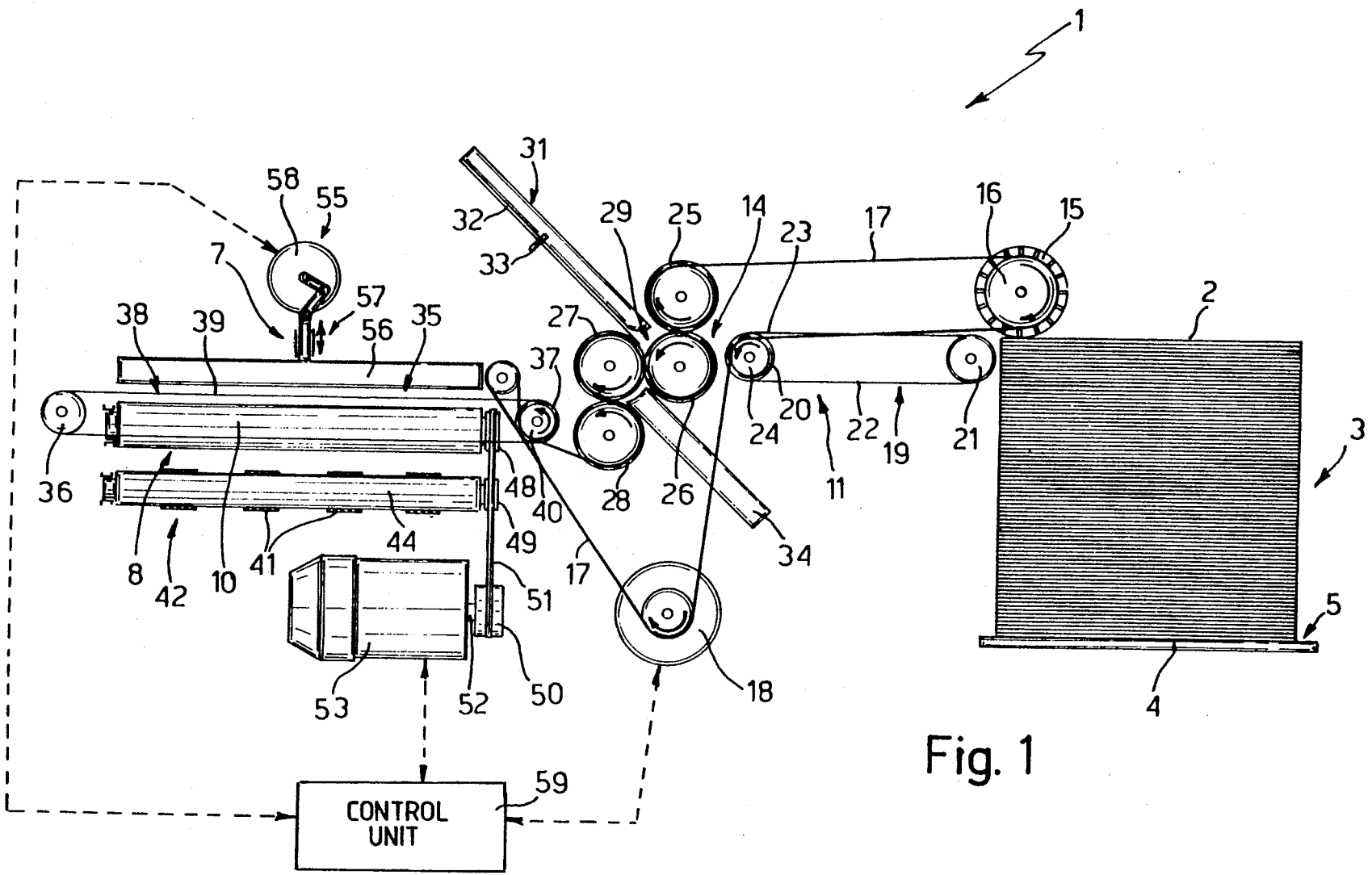
FIG. 1 shows a side view, with parts removed for clarity, of a preferred embodiment of the folding machine according to the present invention.
Figure 2:
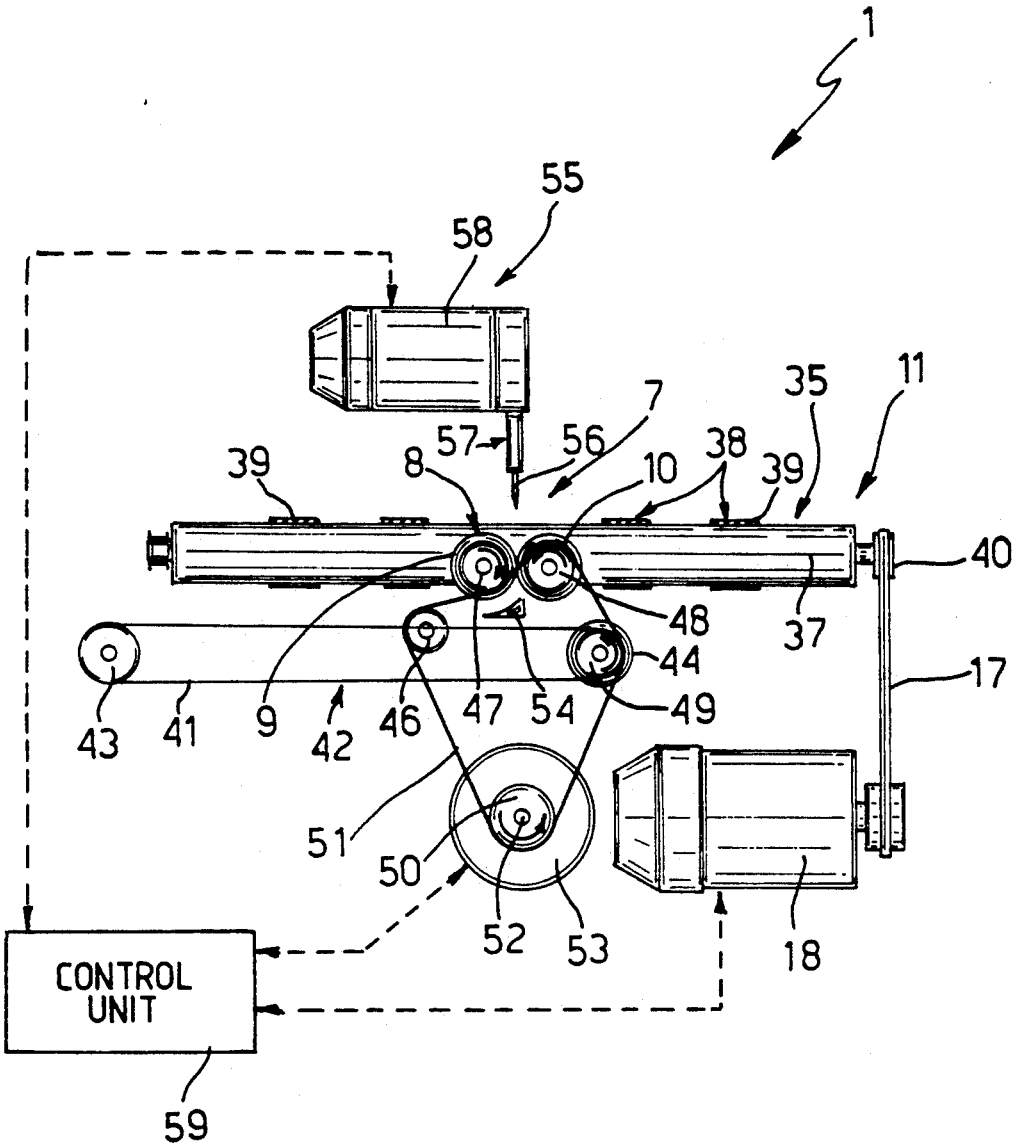
FIG. 2 shows a side view of a detail in FIG. 1.
Figure 3:
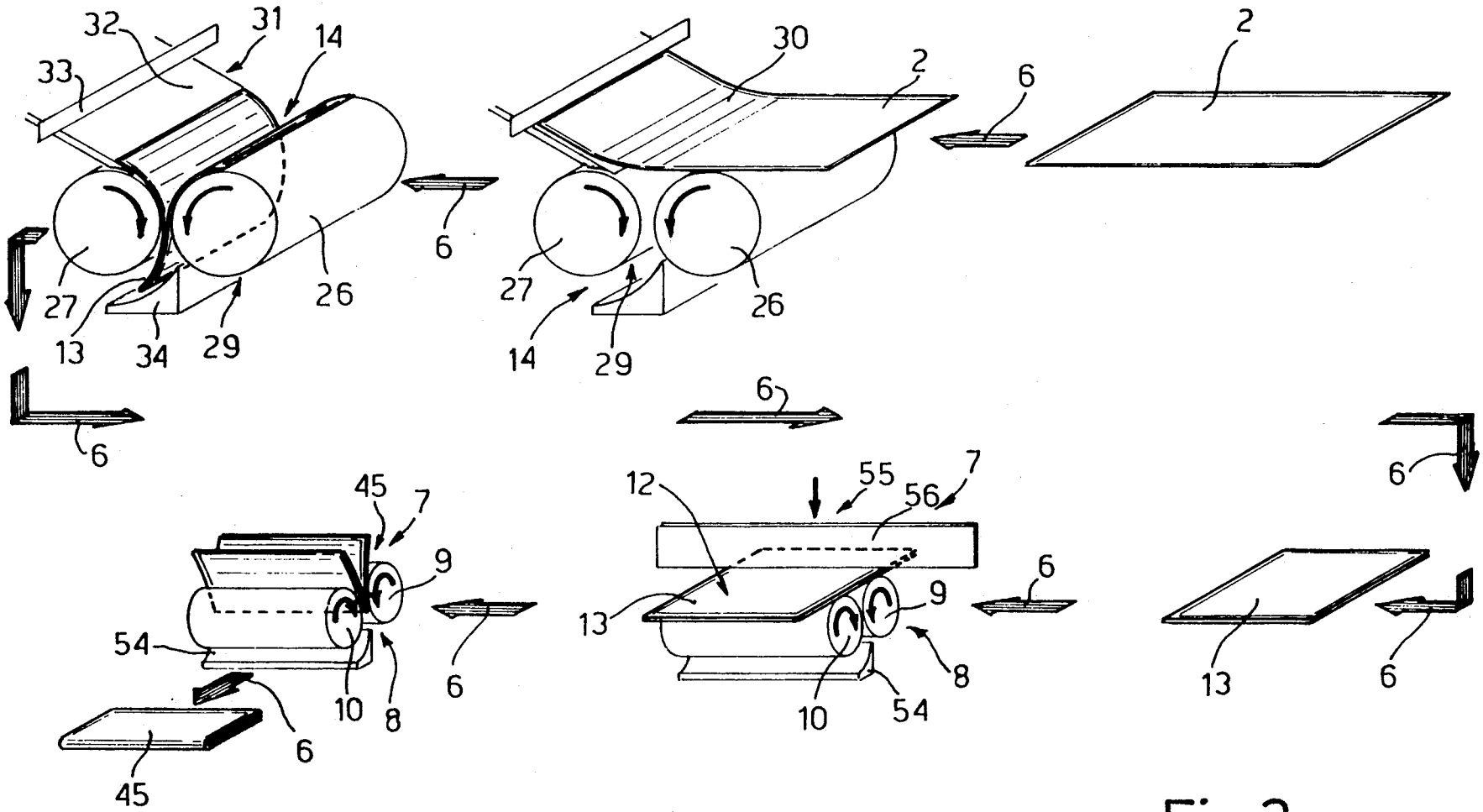
FIG. 3 shows operating diagrams in perspective of the FIG. 1 and 2 machine.

Number 1 in FIGS. 1 and 2 indicates a folding machine for successively withdrawing paper sheets 2 (FIG. 3) from a stack 3 supported on a plate 4 defining a store 5, and feeding them along folding path 6 as shown by the arrows in FIG. 3.

Folding machine 1 in the example shown comprises a folding station 7 located along path 6 and in turn comprising a folding unit 8 defined at least partially by two counter-rotating rollers 9 and 10; and a feed unit 11 for supplying folding unit 8 with the intermediate portion 12 (FIG. 3) of a succession of first signatures 13 (FIG. 3), each produced by folding a respective sheet 2 in half by means of a continuous folding device 14 forming part of feed unit 11.

As shown in FIG. 1, feed unit 11 comprises a suction roller 15, the outer periphery of which is maintained contacting the top end of stack 3 as plate 4 is moved vertically by actuating means not shown. Roller 15 presents an end pulley 16 engaged by a belt 17 driven by motor 18, the speed of which is variable continuously for rotating roller 15 clockwise in FIG. 1, and successively feeding sheets 2 in stack 3 on to a conveyor belt 19.

Conveyor 19 comprises two rollers 20 and 21 about which is looped a belt 22, the top portion 23 of which receives sheets 2 and feeds them leftwards in FIG. 1, by virtue of the drive transmitted by belt 17 to a pulley 24 coaxial and angularly integral with roller 20.

Roller 20 at the output end of conveyor 19 is located facing the input of device 14, which comprises two first input feed rollers 25 and 26 tangent to each other and to the plane of top portion 23 of belt 22; and two second feed rollers 27 and 28 tangent to each other and parallel to rollers 25 and 26. Roller 27 on top of roller 28 is tangent to roller 26, which is located beneath roller 25 and forms, with roller 27, a folding unit 29 for receiving the intermediate portion 30 (FIG. 3) of each sheet 2, and folding sheet 2 in half to produce a respective first signature 13.

Device 14 also comprises a folding well or pocket 31, the bottom wall 32 of which slopes upwards from the plane of top portion 23 of belt 22, and is located over roller 27, on the opposite side of rollers 25 and 26 in relation to conveyor 19. Bottom wall 32 is fitted integral with an adjustable stop element 33 separated from the line of tangency between rollers 26 and 27 by a distance equal to half the length of sheet 2 measured in the traveling direction of conveyor 19.

Device 14 also comprises a guide plate 34 located between rollers 26 and 28, for guiding signatures 13, fold first, from the point of tangency of rollers 26 and 27 to that of rollers 27 and 28.

Feed unit 11 comprises an output conveyor 35 substantially parallel to conveyor 19 and comprising two rollers 36 and 37 parallel to rollers 20, 21, 25, 26, 27 and 28, and about which are looped strips 38. The top portions 39 of strips 38 are coplanar with the line of tangency between rollers 27 and 28, and provide for receiving signatures 13 and feeding them leftwards in FIG. 1 by virtue of drive transmitted by belt 17 to a pulley 40 coaxial and angularly integral with roller 37.

As shown more clearly in FIG. 2, rollers 9 and 10 of folding unit 8 extend perpendicular to rollers 36 and 37, between two adjacent strips 38, and are tangent to each other along a line parallel to the plane defined by top portions 39 and between this plane and a plane defined by the top portions of a number of looped strips 41 of a conveyor 42. Conveyor 42 comprises two rollers 43 and 44 parallel to each other and to rollers 9 and 10, and constitutes the output conveyor of machine 1, or an infeed conveyor for successively feeding second signatures 45, formed on folding unit 8, to a further folding station (not shown) similar to station 7.

Folding station 7 also comprises pulleys 46, 47, 48, 49 and 50, all engaged by the same belt 51. Pulley 46 is a transmission pulley, while the others are fitted respectively to rollers 9, 10 and 44, and to the output shaft 52 of a variable-speed motor 53.

Folding station 7 also comprises a guide plate 54 for guiding signatures 13 from folding unit 8 on to conveyor 42; and a further feed unit consisting of a knife device 55 comprising a knife 56 located over the line of tangency of, and parallel to, rollers 9 and 10, and moved back and forth, perpendicular to the plane of top portions 39 of strips 38 and to and from said line of tangency, by a crank mechanism 57 powered by a variable-speed motor 58.

Motors 18, 53 and 58 are all connected to a main control unit 59 by which the speed of one of the motors is associated with definite speeds of the other two motors according to a given program.

As shown in FIGS. 1 and 3, on being withdrawn off the top of stack 3 by roller 15,, sheet 2 is fed by conveyor 19 between rollers 25 and 2.6, and proceeds along bottom wall 32 of pocket 31 until the front edge is arrested contacting stop element 33. As belt 17 continues rotating rollers 25 and 26 after the front edge of sheet 2 contacts stop element 33, intermediate portion 30 of sheet 2 is gradually folded downwards and engaged between rollers 26 and 27, which fold sheet 2 in half to produce signature 13. This is fed by rollers 26 and 27 on to guide plate 34 by which it is fed between rollers 27 and 28 and on to conveyor 35, the speed of which equals the surface speed of rollers 27 and 28.

When fed by conveyor 35 on to folding unit 8, intermediate portion 12 of signature 13 is engaged by knife 56 of device 55 and fed between rollers 9 and 10 of folding unit 8, which folds signature 13 in half to produce signature 45.

Clearly, therefore, when dealing with sheets 2 of the maximum size permitted on machine 1, the most highly stressed unit governing the maximum output rate of the machine consists of folding unit 8, which must be accelerated, by regulating motor 53, so as to remove signature 45 through the plane of the top portions of strips 41 prior to the arrival of the front edge of the next signature 13.

When dealing with sheets 2 of the smallest size permitted on machine 1, on the other hand, the most highly stressed unit governing the output rate of machine 1 consists of knife device 55, which must be accelerated, by regulating motor 58, so as to return to its position over the plane of the top portions of strips 41 prior to the arrival of the front edge of the next signature 13.

In other words, therefore, using a respective independently operating motor for each of the feed and folding units, it is possible to select the output rate best suited to a given format of sheet 2.

Obviously, once the output rate, to which corresponds a given operating speed of one of motors 18, 53 and 58, is selected, main control unit 59 provides for regulating the speed of the other two motors accordingly, so that the feed and folding units operate in time with each other.

I claim:

1. A folding machine particularly for sheets such as signatures, comprising:

at least one folding station having a folding unit located at the folding station and including two counter-rotating rollers, and pushing means to feed an intermediate portion of each said sheet between said rollers;

a feed unit for feeding the sheets in succession along a predetermined path to the folding station and into engagement with the folding unit;

first, second and third independent drive means to drive said feed unit, the two rollers, and said pushing means respectively at respective variable speeds; and a programmed control unit for coordinating said drive means so as to keep each said speed below a respective preset value.

2. The folding machine as claimed in claim 1, wherein said feed unit comprises a first conveyor extending over the counter-rotating rollers and parallel thereto for feeding the sheets between the two rollers and said pushing mans; with said first drive means powering the first conveyor.

3. The folding machine as claimed in claim 2, wherein said pushing means comprise a knife parallel to said two rollers and powered by said third drive means to move said knife through the first conveyor to and from the two rollers.

4. The folding machine as claimed in claim 2, further comprising a second conveyor for receiving sheets folded at said folding station; said second conveyor being powered by said second drive means together with said two rollers.

5. The folding machine as claimed in claim 2, wherein said feed unit comprises a further folding unit powered by said first drive means.

6. The folding machine of claim 1 wherein each of said independent drive means comprises a separate motor.

7. A folding machine particularly for sheets such as signatures, comprising:

at least one folding station;

a folding unit located at the folding station and including two counter-rotating rollers;

at least one feed unit for supplying the folding unit with an intermediate portion of each said sheet;

independent and separate drive means for each said unit to drive said units at respective variable speeds; and a programmed control unit for coordinating said drive mans so as to keep each said speed below a respective present value.

* * * * *